US005125852A

United States Patent [19]

Archer

[11] Patent Number: 5,125,852

[45] Date of Patent: Jun. 30, 1992

[54] UNIVERSAL ELECTRICAL CONNECTOR JACK

[75] Inventor: Lee A. Archer, Asheville, N.C.

[73] Assignee: Superior Modular Products, Inc., Swannanoa, N.C.

[21] Appl. No.: 729,578

[22] Filed: Jul. 15, 1991

[51] Int. Cl.[5] ..... H01R 13/74

[52] U.S. Cl. ..... 439/555; 439/135

[58] Field of Search ..... 439/544, 555, 676, 135

[56] References Cited

U.S. PATENT DOCUMENTS 3,523,269 8/1970 Witter et al. ..... 439/557 X 4,315,664 2/1982 Hughes et al. ..... 439/676 X 4,602,842 7/1986 Free et al. ..... 439/676 X

FOREIGN PATENT DOCUMENTS 0184745 8/1963 Sweden ..... 439/557

*Primary Examiner*—Eugene F. Desmond

*Attorney, Agent, or Firm*—Carter and Schnedler

[57] ABSTRACT

There is provided an electrical connector jack which is adapted to readily be used with panels having various thicknesses. The jack has a pair of flexible stops in the form of ears extending therefrom which abut against one side of the panel. The flexibility of the ears permits the jack to move over a range of distance after having been inserted into an opening in the panel. The jack further includes additional stops in the form of beams which contact the other side of the panel to further secure the jack in the opening in the panel. The beams are also flexible thereby permitting the jack to snap into the panel. A cover is also provided to conceal the jack and to lock the jack into the opening in the panel.

14 Claims, 3 Drawing Sheets

UNIVERSAL ELECTRICAL CONNECTOR JACK

BACKGROUND OF THE INVENTION

This invention relates to electrical connectors. More particularly it relates to electrical connector jacks which are to be fitted into openings in panels.

Modular electrical connector products for the telecommunications industry, particularly plugs and jacks, have achieved wide acceptance. Plugs and jacks are generally intermatable because the inside dimensions of the jack and the outside dimensions of the plug are in accordance with government mandated standards under Part 68 of the Regulations of the Federal Communications Commission. Thus to a great extent the success of those modular products comes from the economics of scales presented to manufacturers by the mandated dimensions.

Jacks are normally mounted to a panel such as a face plate, wall baseboard, modular function, posted panel, or a rack. The panel includes an opening through which the jack is mounted. The electrical contacts on the inside of the jack are exposed through the opening in the panel and the jack mates with a corresponding plug through the opening. Thus an electrical connection is made through the panel.

Often jacks are secured to the panel by means of screws resulting in labor-intensive installations. Other jacks are held in place by stops which form a gap approximately equal to the thickness of the panel through which the plug is inserted. However, because various panels and various types of panels have varying thicknesses, a different jack often must be used for a particular panel thickness, otherwise the jack will not fit properly in the opening in the panel. This of course increases tooling and inventory costs.

OBJECTS OF THE INVENTION

It is therefore one object of this invention to provide an electrical connector jack which will fit panels having varying thicknesses.

It is another object to provide a universal jack which is inexpensive to manufacture and is easy to install.

It is another object to provide a jack which may be fitted onto a panel without the need for special tools.

It is another object to provide a jack which is easily mounted and dismounted from a panel.

SUMMARY OF THE INVENTION

In accordance with one form of this invention, there is provided an electrical connector apparatus in the form of a jack having an opening therein for receiving a corresponding plug. Portions of the jack are adapted to extend into an opening in a panel such as a face plate. The jack includes a first stop. The first stop contacts one side of the panel and upon such contact permits the jack to extend into the opening of the panel over a range of distance thereby permitting the jack to be used with various thicknesses of panels. The jack includes a second stop which is adapted to contact the other side of the panel for securing the jack in the opening of the panel.

Preferably the first stop is resilient. It is also preferred that the first stop be in the form of a pair of flexible ears extending from the two sides of the jack. Also in the preferred embodiment, the second stop is in the form of at least one moveable beam extending from the jack to the other side of the panel and having a ledge extending from the free end thereof so that the jack may be snap fitted into the opening in the panel.

It is also preferred that a cover plate be provided which includes at least one post which contacts the beam and depresses the beam in one direction so as to lock the jack into the opening in the panel. The cover plate may include a plate for tabs which extend into the opening of the jack for use when a plug having fewer contacts than the jack is used thereby making the jack more versatile.

BRIEF DESCRIPTION OF THE DRAWINGS

The subject matter which is regarded as the invention is set forth in the appended claims. The invention itself however together with further objects and advantages thereof may be better understood by reference to the following description taken in conjunction with the accompanying drawings in which:

DESCRIPTION OF THE PREFERRED EMBODIMENT

Figure 1:
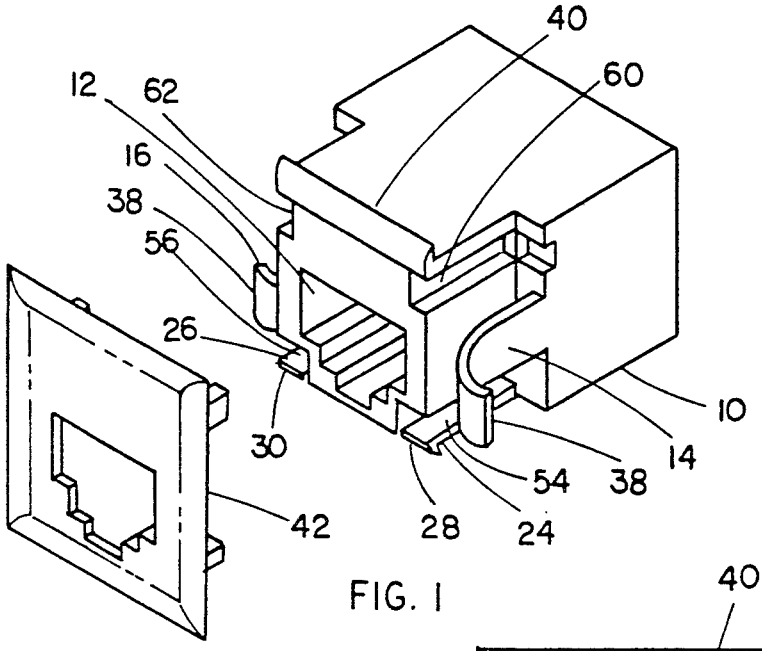
FIG. 1 is a pictorial view showing the apparatus of the subject invention with the cover plate having been removed from the jack for clarity.
Figure 2:
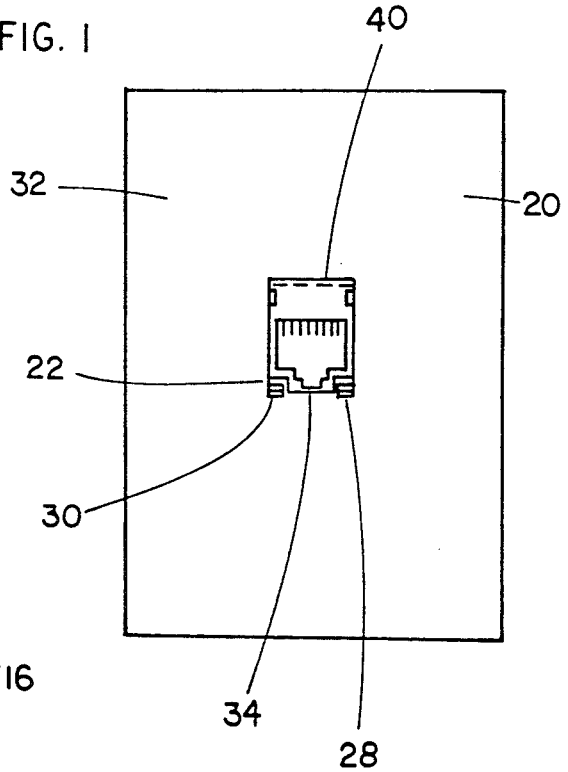
FIG. 2 is a front elevational view of the jack of FIG. 1 with the jack having been inserted into a panel.
Figure 3:
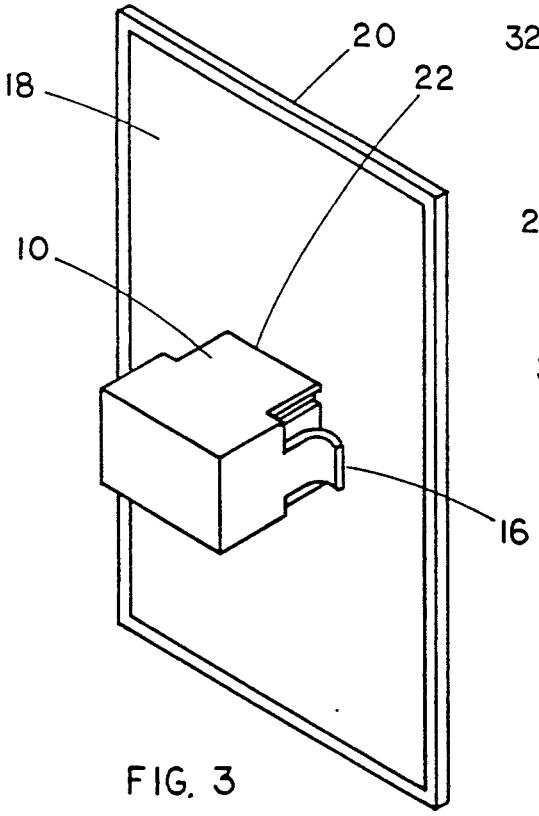
FIG. 3 is a pictorial view of the jack of FIG. 1 with the jack having been inserted into a panel but showing the opposite side to that of FIG. 2.

Referring now more particularly to FIGS. 1 through 9, there is provided electrical connector jack 10 which includes cavity 12 for receiving a corresponding electrical plug (not shown). The dimensions of cavity 12 conform with Part 68 of the Regulations of the Federal Communications Commission. Jack 10 includes a pair of resilient ears 14 and 16 projecting therefrom in a curved fashion. Ears 14 and 16 form a first stop for contacting the backside 18 of panel 20 as shown in FIG. 3. Panel 20 may have various thicknesses and may take various forms such as, for example a wall, a face plate, a baseboard, modular furniture, or a patch panel. The ears 14 and 16 are made resilient by flaring out and curving them from jack 10. Upon contact with the backside 18 of panel 20, jack 10 may be moved in a range of distance into opening 22 in the panel 20, to the extent of the flexibility of ears 14 and 16, thereby enabling the jack to fit into openings of various thicknesses of panels. A jack having the resilient ears described above has been constructed enabling approximately a 1 mm movement of the jack within the opening in a panel. Thus such a jack may be used with panels that vary in thickness by that range of movement, however the invention is not limited to that range of movement.

Jack 10 also includes a pair of beams 24 and 26 projecting therefrom which also form a stop. Beams 24 and 26 include a pair of ledges or hooks 28 and 30 extending from the free ends of the beams. The ledges 28 and 30 attach to front side 32 of panel 20 for securing jack 10 into opening 22 of the panel. Beams 24 and 26 are also resilient and are then able to move upwardly and downwardly so that they may snap fit into opening 22. Each of the ledges 28 and 30 of the beams include a ramp 32 which provides easier access into opening 22 of the panel by permitting beams 24 and 26 to ride upwardly as the ramps contact lower edge 34 of opening 22.

Figure 4:
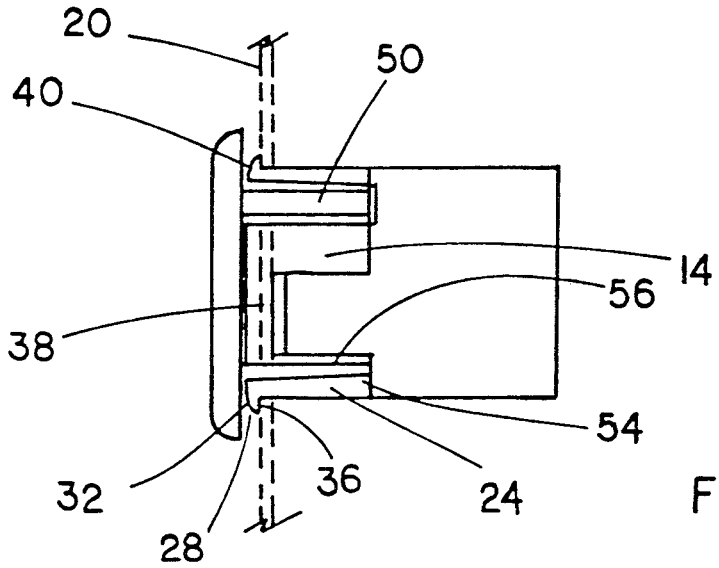
FIG. 4 is a side elevational view of the jack and cover plate of FIG. 1 but showing the cover plate attached to the jack and further showing the panel in phantom for clarity.
Figure 6:
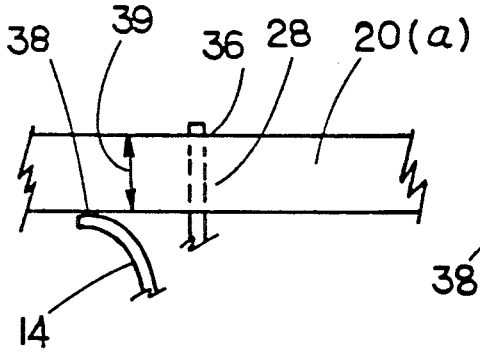
FIG. 6 is a partial top view of the apparatus of FIG. 4 showing one of the ears of the jack deflected by a certain amount due to a panel of one thickness.
Figure 7:
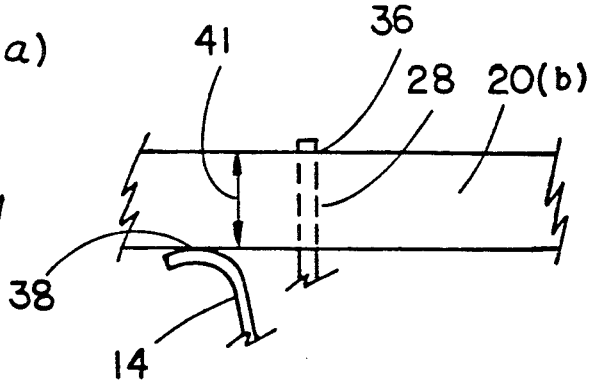
FIG. 7 shows the apparatus of FIG. 6 but with a panel of another thickness so that the ear is deflected by another amount.

As can be seen from FIG. 4, each edge 36 of ledges 28 and 30 is located a predetermined horizontal distance, as measured along the longitudinal axis of the jack, from edge 38 of each of the ear 14 and 16 to the extent of the approximate thickness of panel 20. For a thicker panel, the horizontal distance between the two edges increases as the ears 14 and 16 increase flex. This may be seen better by referring to FIGS. 6 and 7. In FIG. 6 a thin panel 20(*a*) is used. The thickness of the panel 20(*a*) and the horizontal distance from edge 38 of ear 14 to edge 36 of ledge 28 is small as indicated by line 39. In FIG. 7 a thick panel 20(*b*) is used. The thickness of the panel 20(*b*) and the horizontal distance from edge 38 of ear 14 to edge 36 of ledge 28 is greater as indicated by line 41. Also ear 14 is flexed more for the thicker panel.

It is preferred that the horizontal distance between these two edges be slightly less than the most narrow panel feasible so that the ears 14 and 16 will always flex somewhat to tightly secure the jack into opening 22. Jack 10 also includes ledge 40 which also contacts outer wall 32 of panel 20 to aid in securing plug 10 into opening 22 of the panel.

In the preferred embodiment, cover plate 42 is provided for aesthetic appeal by obscuring portions of jack 10 and further for locking jack 10 onto panel 20. Cover plate 42 includes opening 44 which is in the same shape as the opening for cavity 12 in jack 10. It is preferred that the color of the cover plate 42 be the same as the color of panel 20 or another color to identify the jack for a special purpose. Thus, jack 10 may come in a single color because the cover plate will substantially hide the jack thereby reducing the cost of producing the jack.

Figure 5:
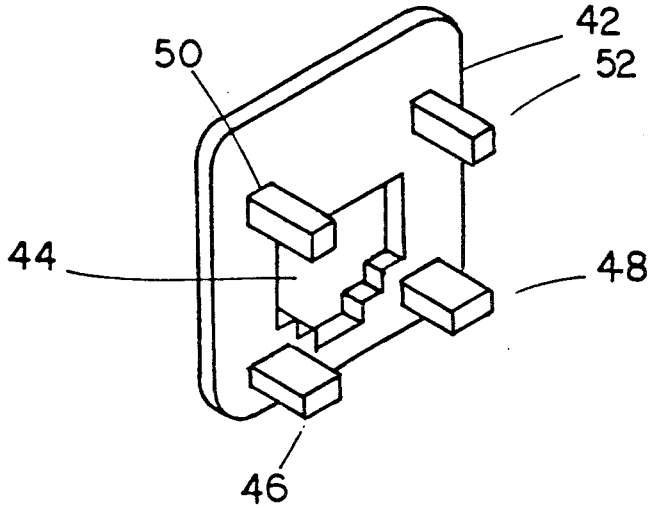
FIG. 5 is a pictorial view of the cover plate shown in FIG. 1 showing the opposite side thereof.

As shown in FIG. 5, cover plate 42 includes a first pair of posts 46 and 48 and a second pair of posts 50 and 52. Posts 46 and 48 are received in gaps 54 and 56 each of which is formed between one of the beams such as beam 24 and portion 56 of the jack. When post 46 is received in gap 54 the post forces resilient beam 24 downwardly thus securing the ledge or hook 28 onto the front side 32 of the panel 20. Studs 50 and 52 are received respectively in slots 60 and 62 of jack 10.

Figure 8:
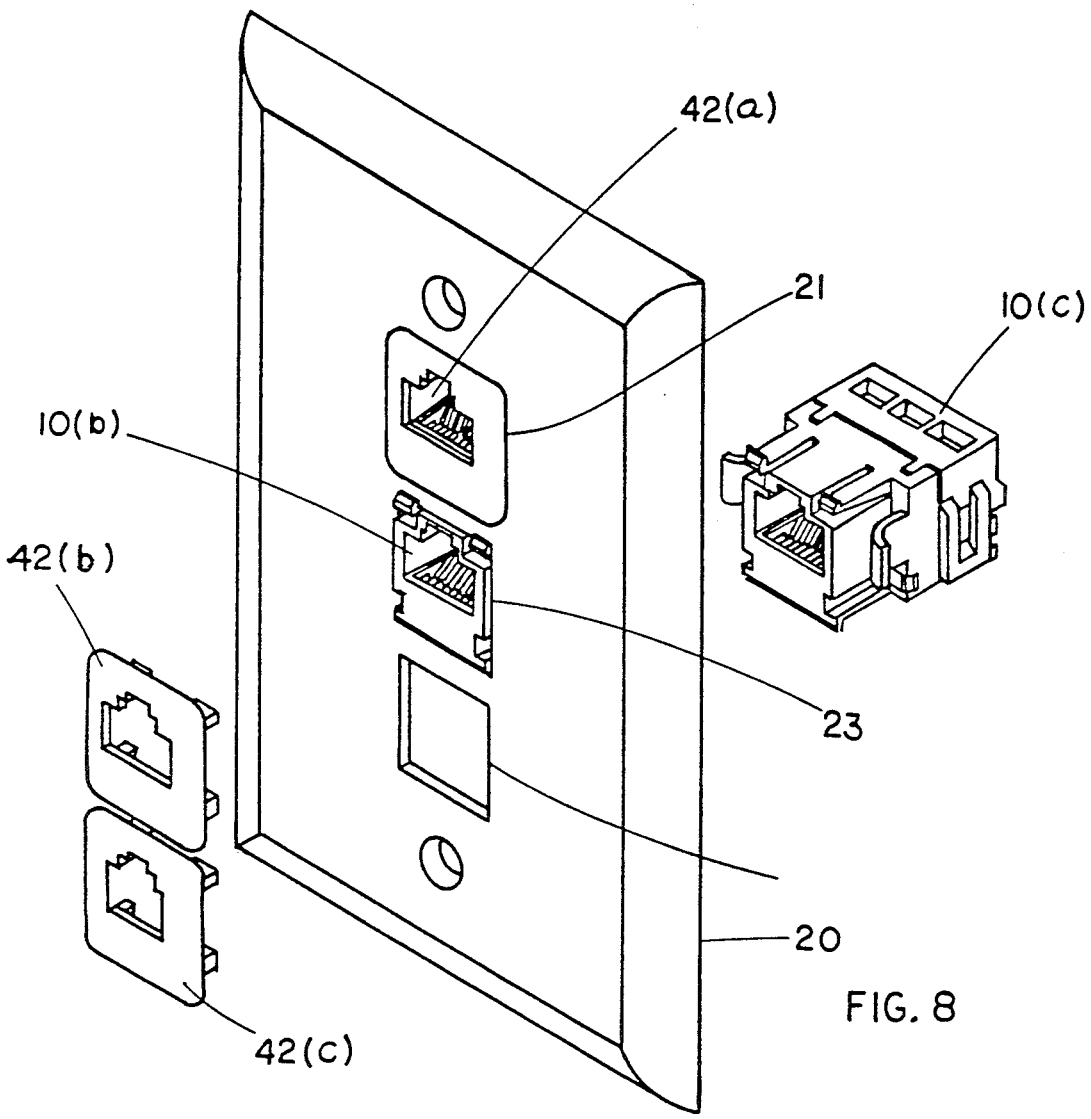
FIG. 8 shows the apparatus of the subject invention with three openings in the panel with the jacks and cover plates in various stages of assembly.

FIG. 8 shows panel 20 with three openings 21, 23 and 25 therein with plugs 10(*a*), 10(*b*), and 10(*c*) and cover plates 42(*a*), 42(*b*), and 42(*c*) in various stages of assembly.

Figure 9:
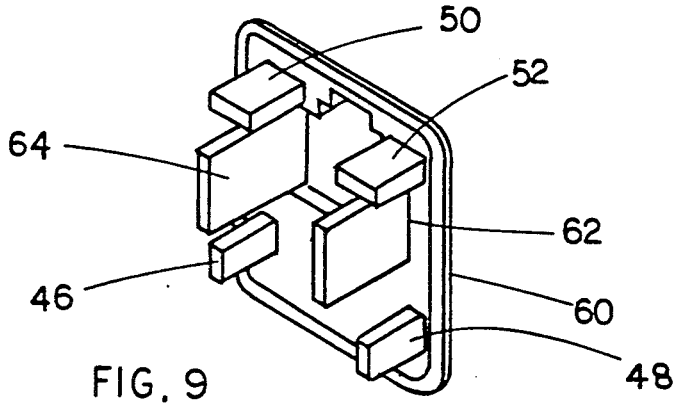
FIG. 9 shows an alternative embodiment to the cover plate shown in FIG. 5.

FIG. 9 shows an alternative cover plate 60 which in addition to posts 46, 48, 50, and 52 includes a pair of tabs 62 and 64. Cover plate 60 would be used in situations for example where a six contact plug is to be connected to an eight contact jack. Tabs 62 and 64 are received in opening 12 of jack 10 and make contact with the outer contacts of the jack so that none of the contacts of the six contact plug would improperly make contact with the outer contacts. Thus jack 10 is made even more versatile since a single eight contact jack may be used with eight, six, and even four contact jacks.

Thus an electrical connector jack is provided which is universal in that it will fit varying thicknesses of panels and various types of panels and may be easily mounted to such panels by snap fitting the jack thereto without the need for special tools, and may be used with various sizes of plugs. The jack may be locked onto the panel by means of a cover plate which also provides an improved appearance.

From the foregoing description of the preferred embodiment of the invention it will be apparent that many modifications may be made therein without departing from the true spirit and scope of the invention.

I claim:

1. An electrical connector apparatus comprising:

a jack having an opening therein for receiving a plug, portions of said jack being adapted to extend into an opening in a panel, and said jack including:

first stop means adapted to contact one side of the panel and permitting said jack to extend over a range of distances into the opening in the panel, whereby said jack may be used with various thicknesses of panels, second stop means adapted to contact the other side of the panel, said second stop means including at least one resilient beam having a portion adapted to extend to the opening in the panel, said first and second stop means securing said jack in the opening in the panel, and a space located between a portion of said at least one beam and a portion of the remainder of said jack, said beam enabled to deflect in said space; and a cover, said cover including an opening therein, said opening in said cover adapted to align with said opening in said jack , said cover removably attached to said jack and adapted to be located on the other side of the panel.

2. An apparatus as set forth in claim 1 wherein said cover includes at least one post extending therefrom; said post received in said space thereby deflecting said beam and locking said jack onto the panel.

3. An apparatus as set forth in claim 2 wherein said at least one beam includes a pair of beams; each of said beams having a space located between said beam and the remainder of the jack; said at least one post being a pair of posts respectively received in said spaces.

4. An apparatus as set forth in claim 1 wherein said first stop means is resilient.

5. An apparatus as set forth in claim 4 wherein said first stop means includes a pair of ears extending from said jack.

6. An apparatus as set forth in claim 5 wherein said ears are curved thereby forming springs which flex upon making contact with one side of the panel.

7. An electrical connector apparatus comprising:

a jack having an opening therein for receiving a plug, portions of said jack being adapted to extend into an opening in a panel, and said jack including:

first stop means adapted to contact one side of the panel and permitting said jack to extend over a range of distances into the opening in the panel, whereby said jack may be used with various thicknesses of panels, second stop means adapted to contact the other side of the panel, said second stop means including at least one resilient beam having a portion adapted to extend to the opening in the panel, said first and second stop means securing said jack in the opening in the panel, and a flange located on said jack opposite to said at least one beam, said flange adapted to contact a portion of the other side of the panel for further securing said jack onto the panel.

8. An electrical connector apparatus comprising:

a jack having an opening therein for receiving a plug, said jack including a plurality of contacts, portions of said jack being adapted to extend into an opening in a panel, and said jack including:

first stop means adapted to contact one side of the panel and permitting said jack to extend over a range of distances into the opening in the panel, whereby said jack may be used with various thicknesses of panels, and second stop means adapted to contact the other side of the panel, said first and second stop means securing said jack in the opening in the panel; and a cover, said cover including:

an opening therein which aligns with at least a part of said opening in said jack, and at least one tab extending from said cover, said tab received in said opening in said jack, and said tab contacting at least one of said contacts.

9. An apparatus as set forth in claim 1 wherein said second stop means is resilient.

10. An apparatus as set forth in claim 9 wherein said second stop means includes at least one beam; a portion of said beam adapted to extend to the opening in the panel.

11. An apparatus as set forth in claim 10 wherein said at least one beam includes a pair of beams.

12. An apparatus as set forth in claim 6 further including a space located between a portion of said at least one beam and a portion of the remainder of said jack, said beam enabled to deflect in said space.

13. An apparatus as set forth in claim 10 wherein said at least one beam includes a ledge extending therefrom; said ledge adapted to contact the other side of the panel.

14. An apparatus as set forth in claim 13 wherein said ledge includes a ramp for enabling said jack to more readily slide into the opening in the panel.

* * * * *